US008225757B2

(12) United States Patent
Kim et al.

(10) Patent No.: US 8,225,757 B2
(45) Date of Patent: Jul. 24, 2012

(54) CONTINUOUS VARIABLE VALVE LIFT APPARATUS

(75) Inventors: Back Sik Kim, Osan (KR); Ingee Suh, Yongin (KR); Dong Hee Han, Seoul (KR); Yooshin Cho, Seoul (KR); Wootae Kim, Suwon (KR); Hyung Ick Kim, Gumpo (KR); Myungsik Choi, Seoul (KR); Dae Sung Kim, Hwaseong (KR); Kyoung Pyo Ha, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 838 days.

(21) Appl. No.: 12/275,106

(22) Filed: Nov. 20, 2008

(65) Prior Publication Data

US 2009/0272345 A1 Nov. 5, 2009

(30) Foreign Application Priority Data

Apr. 30, 2008 (KR) ..... 10-2008-0040845

(51) Int. Cl.
*F01L 1/34* (2006.01)

(52) U.S. Cl. ..... 123/90.16; 123/90.15

(58) Field of Classification Search ..... 123/90.15, 123/90.16

See application file for complete search history.

(56) References Cited

U.S. PATENT DOCUMENTS

| | | | | |
|---|---|---|---|---|
| 6,295,958 | B2 * | 10/2001 | Pierik | 123/90.16 |
| 6,311,659 | B1 * | 11/2001 | Pierik | 123/90.24 |
| 6,386,161 | B2 * | 5/2002 | Pierik | 123/90.16 |
| 6,401,677 | B1 * | 6/2002 | Rohe et al. | 123/90.16 |
| 6,422,187 | B2 * | 7/2002 | Fischer et al. | 123/90.16 |
| 6,439,177 | B2 * | 8/2002 | Pierik | 123/90.16 |
| 6,745,734 | B2 * | 6/2004 | Pierik | 123/90.16 |
| 2006/0112917 | A1 * | 6/2006 | Nakamura et al. | 123/90.16 |

FOREIGN PATENT DOCUMENTS

JP 2006-70739 A 3/2006

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A continuously variable valve lift apparatus includes an input cam disposed to a camshaft and rotating, a follower supporting portion rotatably disposed to the camshaft for changing a relative angle of the follower with respect to the camshaft, a follower that includes a center shaft, is connected with the follower supporting portion via the center shaft, and pivots around the center shaft by receiving rotation movement of the input cam, a straight line guide, an output cam that contacts the follower and reciprocates along the straight line guide, and a valve opening unit that is opened by pushing of the output cam.

17 Claims, 13 Drawing Sheets

CONTINUOUS VARIABLE VALVE LIFT APPARATUS

CROSS-REFERENCE TO RELATED APPLICATION

The present application claims priority to Korean Patent Application No. 10-2008-0040845 filed Apr. 30, 2008, the entire contents of which is incorporated herein for all purposes by this reference.

BACKGROUND OF THE INVENTION

1. Field of the Invention

The present invention relates to a continuous variable valve lift apparatus, and more particularly to a continuous variable valve lift apparatus that can adjust a valve lift amount in response to an operational state of an engine.

2. Description of Related Art

An internal combustion engine generates power by burning fuel in a combustion chamber in an air media that is drawn into the chamber. Intake valves are operated by a camshaft in order to take in the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, optimal opening/closing timing of the valves or an optimal lift depends on the rotation speed of the engine. In order to achieve such an optimal valve operation depending on the rotation speed of the engine, research has been undertaken on a variable valve lift (VVL) apparatus that enables different valve lifts depending on the engine speed.

For such a VVL apparatus, it is recommended that power loss in driving the valves using torque of the camshaft is minimized. In addition, it is recommended that the VVL apparatus is symmetrically designed such that it may be symmetrically installed in both banks in a V-engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuous variable valve lift (CVVL) apparatus having increased operation range of valve lift and to provide a continuous variable valve lift apparatus having the same valve profile for being used in a V-type engine.

A continuously variable valve lift apparatus according to various aspects of the present invention may include an input cam connected to a camshaft and rotating with rotation of the camshaft, a follower supporting portion rotatably coupled to the camshaft, a follower including a center shaft, wherein the follower is pivotally coupled to the follower supporting portion via the center shaft, and pivots around the center shaft by receiving rotation movement of the input cam so as to change a relative angle of the follower with respect to the camshaft, a straight line guide, an output cam that slidably contacts the follower and reciprocates along the straight line guide, and/or a valve opening unit that is opened or closed by the output cam.

The follower supporting portion may include a connecting portion rotatably connected with a cylinder head and the cam shaft. A first elastic member may be disposed between the follower and the follower supporting portion, and supply elastic force to the follower so that the follower is biased toward the input cam.

The follower may include a first roller that contacts the input cam.

The follower may include a contact portion that slidably contacts the output cam.

The output cam may include a second roller that slidably contacts the follower.

A second elastic member may be disposed behind the output cam for supplying elastic force to the output cam so that the output cam is biased toward the follower.

The straight line guide may include a guide roller for the output cam to reciprocate thereon.

The output cam may include a driving portion having a zero lift section substantially in parallel to the straight line guide and a lift section that becomes gradually more distant from the zero lift section. The driving portion may further include a ramp section formed between the zero lift section and the lift section for preventing a rapid change in valve profile. A straight line, which connects a contact point formed between the follower and a curvature of the output cam and a center of the camshaft, may be substantially in parallel to longitudinal axis of the straight line guide.

The continuously variable valve lift apparatus may further include a control portion for controlling the relative angle of the follower with respect to the camshaft. The control portion may include a control shaft. The control portion may further include an eccentric shaft housing, and a stopper is formed to the eccentric shaft housing for limiting the relative angle of the follower with respect to the camshaft within a predetermined angle, wherein the eccentric shaft housing is rotatably coupled to the follower supporting portion and the control shaft is coupled to the eccentric shaft housing so that rotation centers of the control shaft and the eccentric shaft housing are offset with a predetermined distance.

In another aspect of the present invention, a pair of input cams, the straight line guides, the output cams, and the valve opening units may be disposed on the engine, the input cams rotate in the same direction, and the followers and the follower supporting portions are reversely disposed with respect to a straight line connecting rotation centers of a pair of the camshafts for having the same valve profile.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
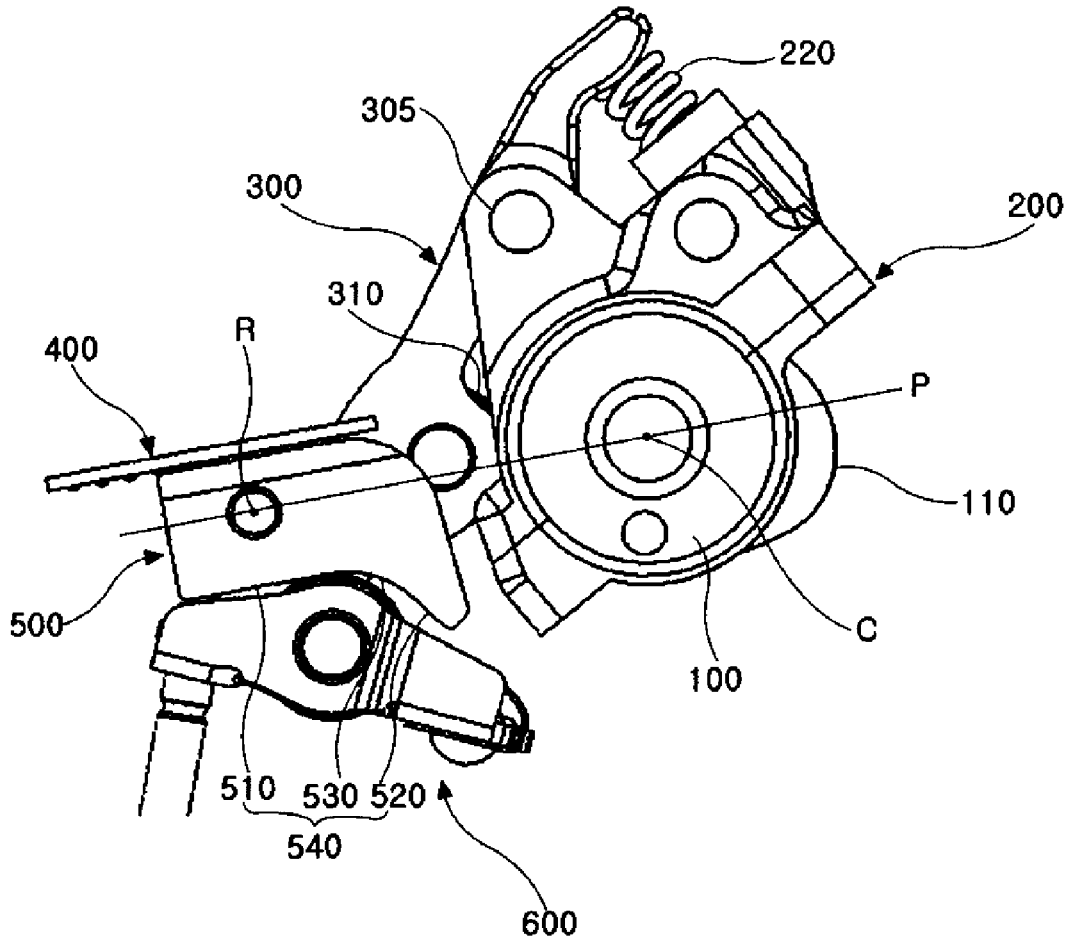
FIG. 1 is a front view of an exemplary continuously variable valve lift apparatus according to the present invention.
Figure 2:
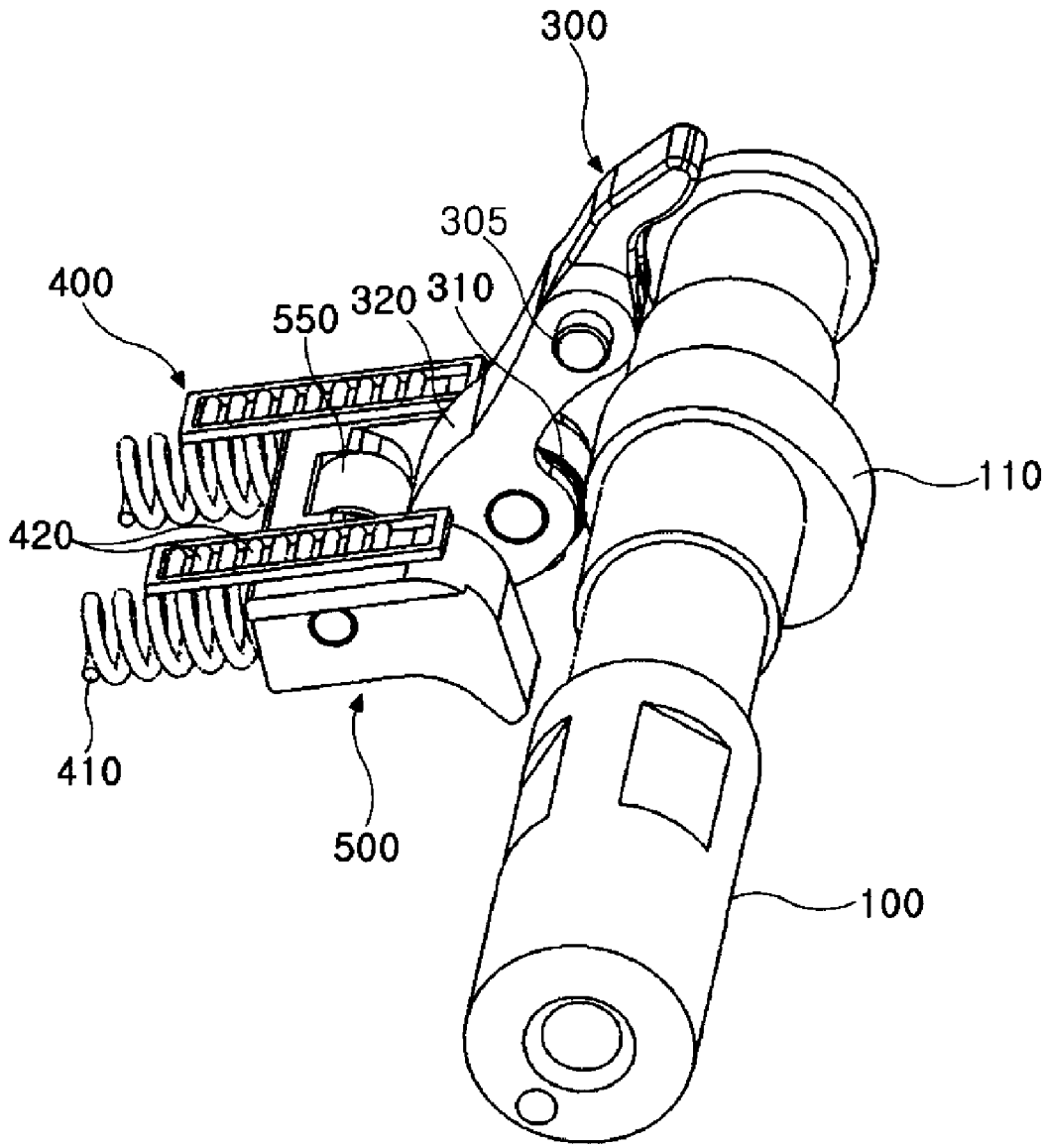
FIG. 2 is a perspective view of an exemplary continuously variable valve lift apparatus according to the present invention.
Figure 3:
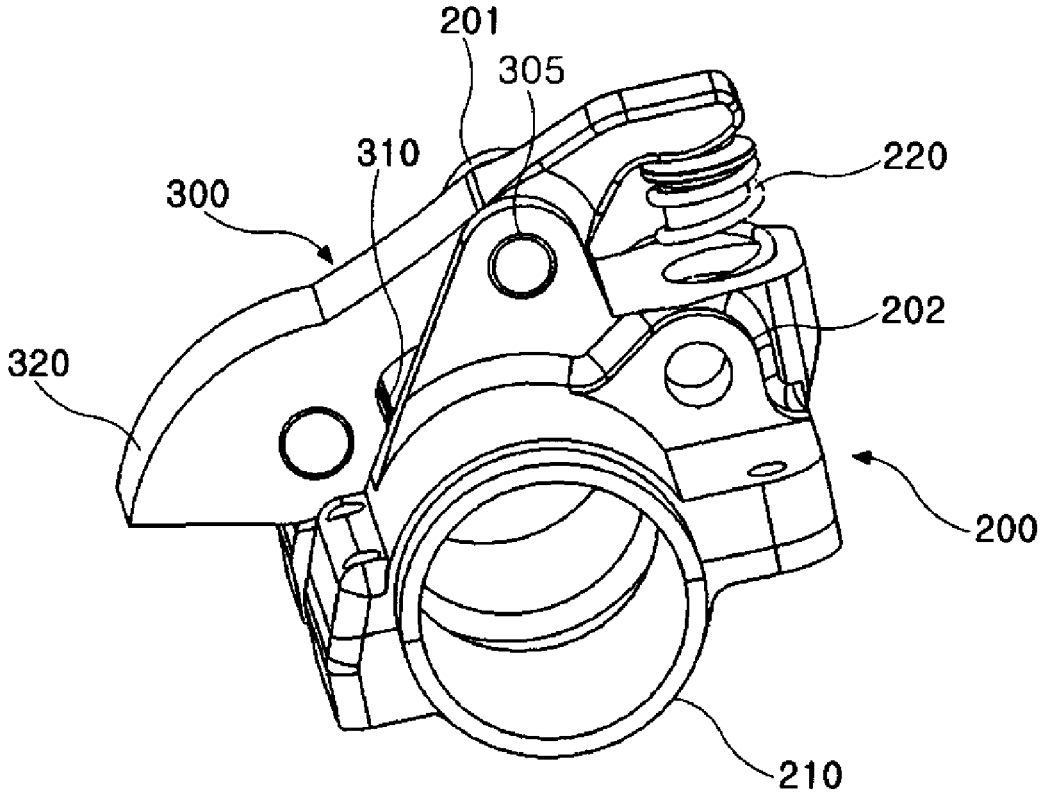
FIG. 3 is a perspective view showing a follower and a follower supporting portion of an exemplary continuously variable valve lift apparatus according to the present invention.

FIG. 1 and FIG. 2 are respectively a front view and a perspective view of a continuously variable valve lift apparatus according to various embodiments of the present invention, and FIG. 3 is a perspective view showing a follower and a follower supporting portion of a continuously variable valve lift apparatus according to various embodiments of the present invention.

Referring to FIG. 1 to FIG. 3, a continuously variable valve lift apparatus according to various embodiments of the present invention includes an input cam 110 that is disposed to a camshaft 100 and rotates, and a follower supporting portion 200.

The follower supporting portion 200 is rotatably disposed to the camshaft 100 such that a relative angle of the follower 200 around the camshaft 100 can be changed.

A follower 300 with a center shaft 305 is supported by the follower supporting portion 200 and the follower 300 is connected with the follower supporting portion 200 via the center shaft 305.

The follower 300 receives rotation movement of the input cam 110 and pivots around the center shaft 305.

An output cam 500 contacting the follower 300 is disposed to reciprocate along a straight line guide 400.

A valve opening unit 600 is disposed for contacting the output cam 500.

A first elastic member 220 is disposed between the follower 300 and the follower supporting portion 200 for supplying restoring force to the follower 300 so that the follower 300 contacts the input cam 110.

A first roller 310 contacting the input cam 110 and a contact portion 320 contacting the output cam 500 are provided to the follower 300.

A second roller 550 contacting the follower 300 is disposed to the output cam 500.

A second elastic member 410 is disposed between the straight line guide 400 and the output cam 500 for supplying restoring force to the output cam 500 so that the output cam 500 contacts the contact portion 320 of the follower 300.

A guide roller 420 is disposed to the straight line guide 400 for the output cam 500 to reciprocate smoothly.

A driving portion 540 contacting the valve opening unit 600 is formed to the output cam 500, and the driving portion 540 includes a zero lift section 510 parallel to the straight line guide 400 and a lift section 520 that becomes gradually more distant from the zero lift section 400. A ramp section 530 is formed between the zero lift section 510 and the lift section 520 for preventing a rapid change in valve profile.

Figure 4:
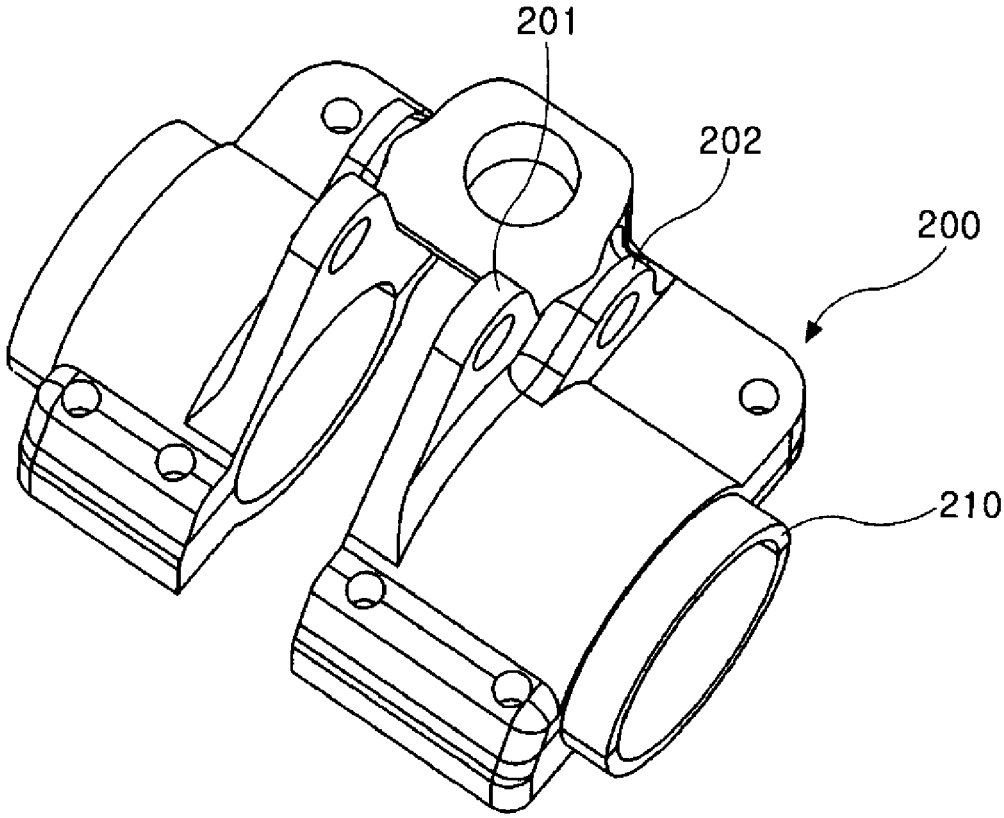
FIG. 4 is a perspective view showing a follower supporting portion of an exemplary continuously variable valve lift apparatus according to the present invention.
Figure 5:
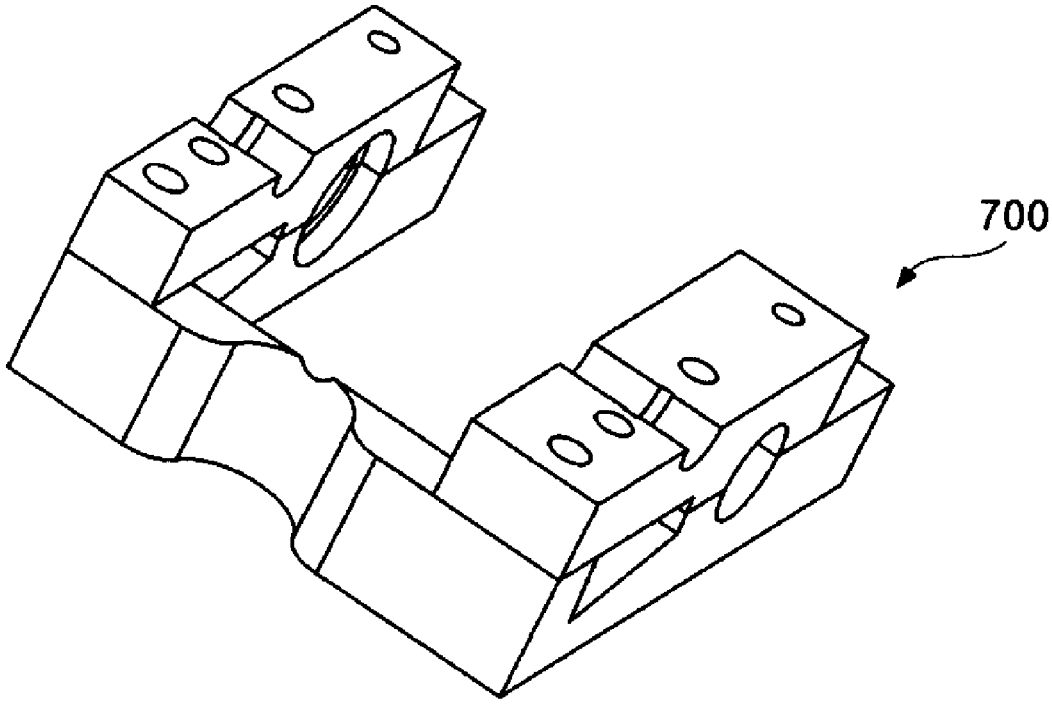
FIG. 5 is a perspective view showing a cylinder head of an exemplary continuously variable valve lift apparatus according to the present invention.
Figure 6:
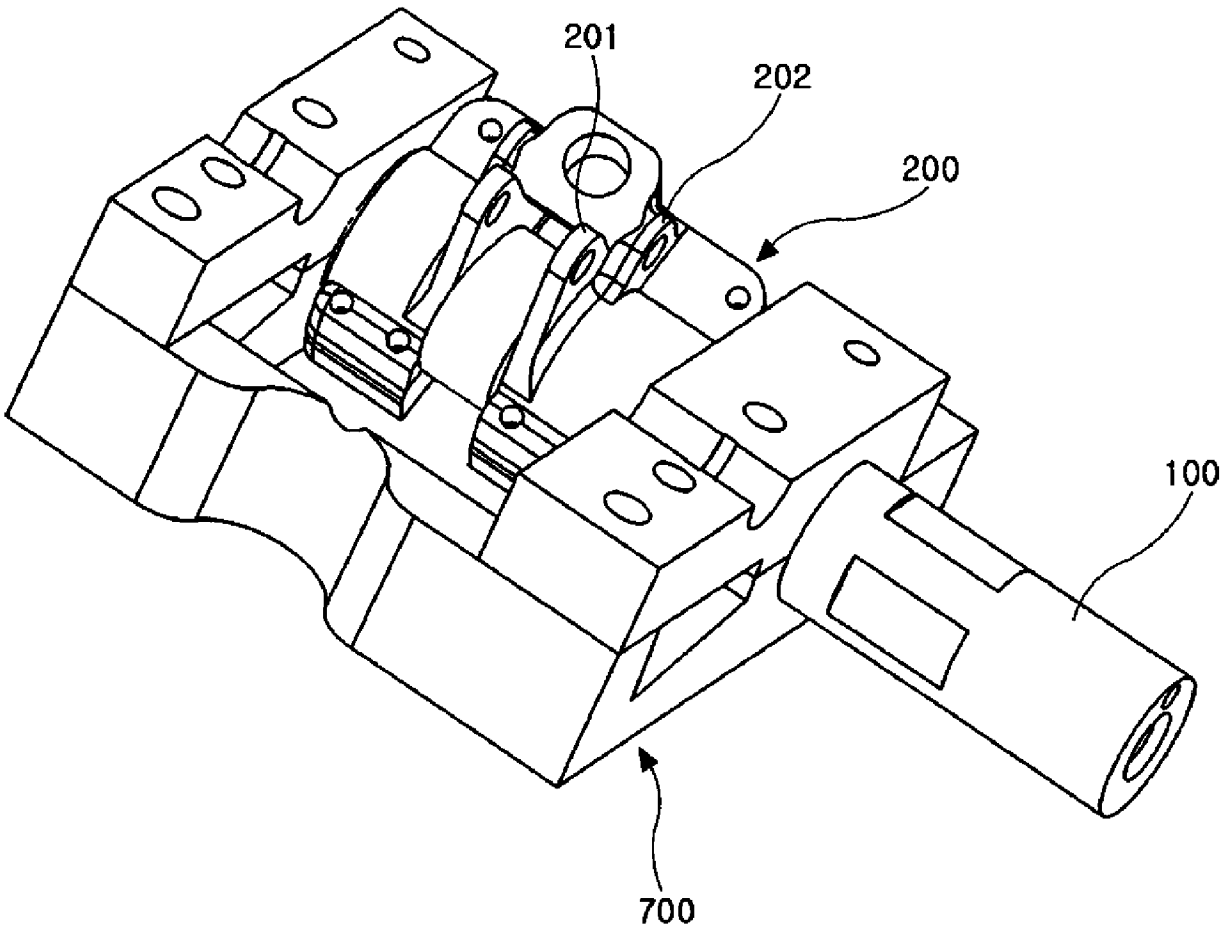
FIG. 6 is a perspective view showing a cylinder head of an exemplary continuously variable valve lift apparatus according to the present invention.

FIG. 4 is a perspective view showing a follower supporting portion of a continuously variable valve lift apparatus according to various embodiments of the present invention, FIG. 5 is a perspective view showing a cylinder head of a continuously variable valve lift apparatus according to various embodiments of the present invention, and FIG. 6 is a perspective view showing a cylinder head of a continuously variable valve lift apparatus according to various embodiments of the present invention.

The follower supporting portion 200 includes a connecting portion 210, and the connecting portion 210 is connected with a cylinder head 700.

A center shaft supporting portion 201 is formed to the follower supporting portion 200 and is connected with the center shaft 305 of the follower 300, and a control connecting portion 202 is connected with a control portion 800 that will be explained later.

Figure 7:
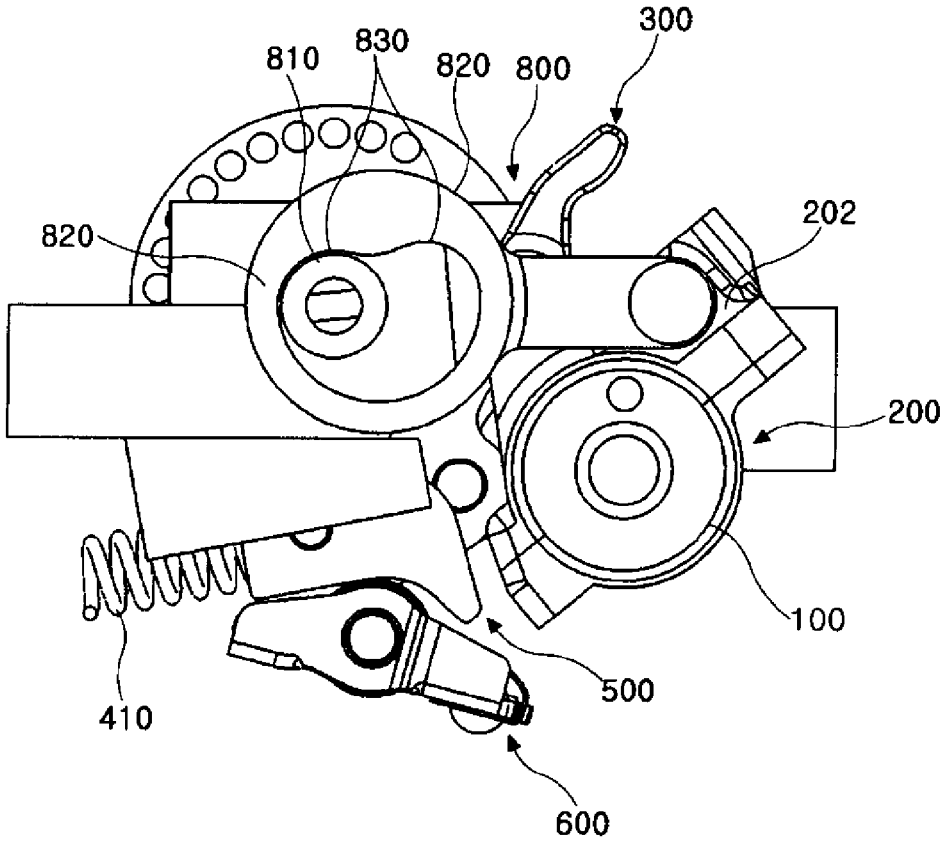
FIG. 7 is a front view including a control portion of an exemplary continuously variable valve lift apparatus according to the present invention.
Figure 8:
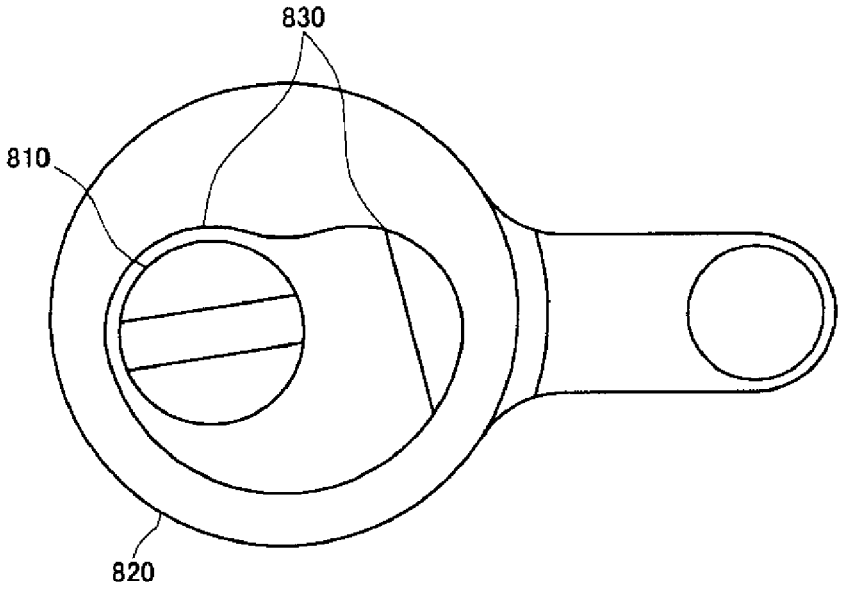
FIG. 8 is a front view showing partial elements of the control portion of an exemplary continuously variable valve lift apparatus according to the present invention.

FIG. 7 is a front view including a control portion of a continuously variable valve lift apparatus according to various embodiments of the present invention, and FIG. 8 is a front view showing partial elements of the control portion of a continuously variable valve lift apparatus according to various embodiments of the present invention.

The control portion 800 is connected with the follower supporting portion 200 for controlling a position of the center shaft 305 of the follower 300.

The control portion 800 includes a control shaft 810 and an eccentric shaft housing 820, and a stopper 830 is formed to the eccentric shaft housing 820 for limiting the relative angle between the follower 300 and the camshaft 100 within a predetermined angle.

As shown in FIG. 8, when the eccentric shaft housing 820 turns around the control shaft 810. Since rotation centers of the control shaft 810 and the eccentric shaft housing 820 are offset with a predetermined distance each other, the stopper 830 limits the rotation angle of the control connecting portion 202 of the follower supporting portion 200 to a predetermined angle around the cam shaft 100 so that the relative distance between the first roller 310 and the camshaft 100 is controlled. Further, the stopper 830 prevents release of the follower supporting portion 200 from the control shaft 810 so that a malfunction can be prevented.

Figure 9:
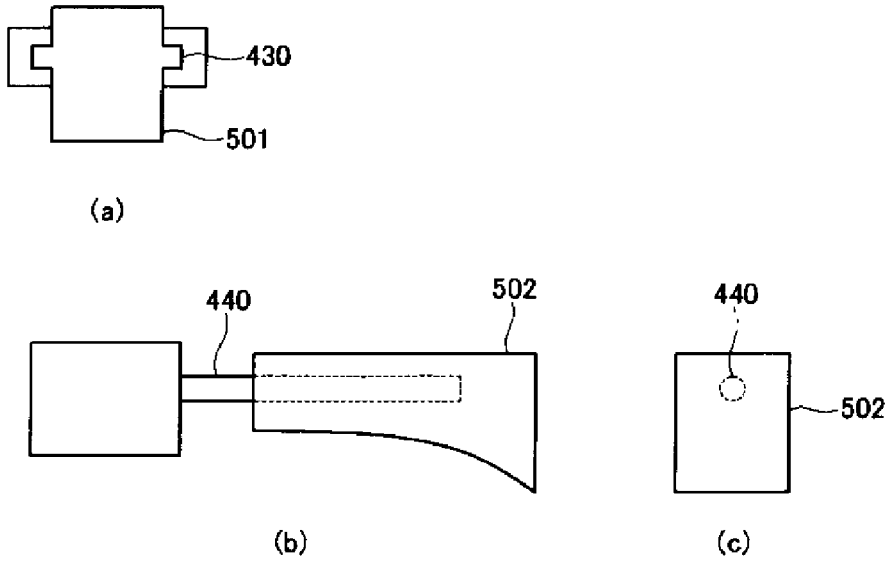
FIG. 9 is a drawing showing a modification of a straight line guide of an exemplary continuously variable valve lift apparatus according to the present invention.

FIG. 9 is a drawing showing a modification of a straight line guide of a continuously variable valve lift apparatus according to various embodiments of the present invention.

Referring to FIG. 9*a* to FIG. 9*c*, the straight line guide 400 is provided with a guide rail 430 or a guide shaft 440 for an output cam 501 and 502 to reciprocate along the straight line guide 400.

The scheme of the straight line guide 400 is not limited to the exemplary embodiments shown in the drawings, and on the contrary it is intended to cover various modifications and equivalent arrangements included within the spirit and scope of the appended claims.

Figure 13:
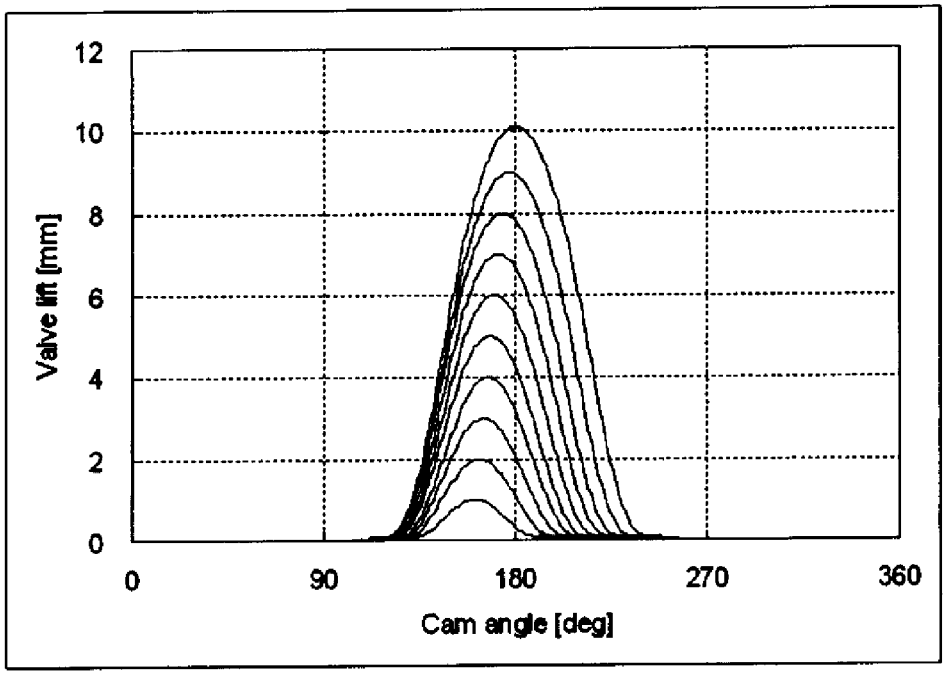
FIG. 13 is a graph showing a profile characteristic of an exemplary variable valve lift apparatus according to the present invention.

FIG. 13 is a graph showing a profile characteristic of a variable valve lift apparatus according to various embodiments of the present invention.

As shown in FIG. 13, it is preferable that a valve lift profile is advanced when valve lift is reduced.

In a V-type engine, both valve profiles of the opposite banks have to be the same for minimizing fluctuation of engine torque. Thus, input cams in both the banks must rotate in opposite directions. However, for realizing that scheme, many elements are needed and the weight of a continuous variable valve lift apparatus is increased.

If the continuous variable valve lift apparatus is used in a V-type engine, profiles of both banks must be the same so that the construction direction of the straight line guide 400 is limited. That is, a curvature center of a contact portion of the output cam 500 contacting the follower 300 must meet certain conditions.

In FIG. 1 and FIG. 2, the second roller 550 contacts the output cam 500.

A connecting line P connecting a center of the second roller R and a center of the camshaft C is parallel to the straight line guide 400 for profiles of both banks to be the same.

If a roller is not provided to an output cam and a curvature of the output cam contacts a follower, a virtual line connecting a contact point formed between the follower and a curvature of the output cam and a center of the camshaft must be substantially in parallel to longitudinal axis of the straight line guide. If a plane of an output cam contacts a follower, the plane contacting the follower must be perpendicular to a straight line guide.

Figure 10:
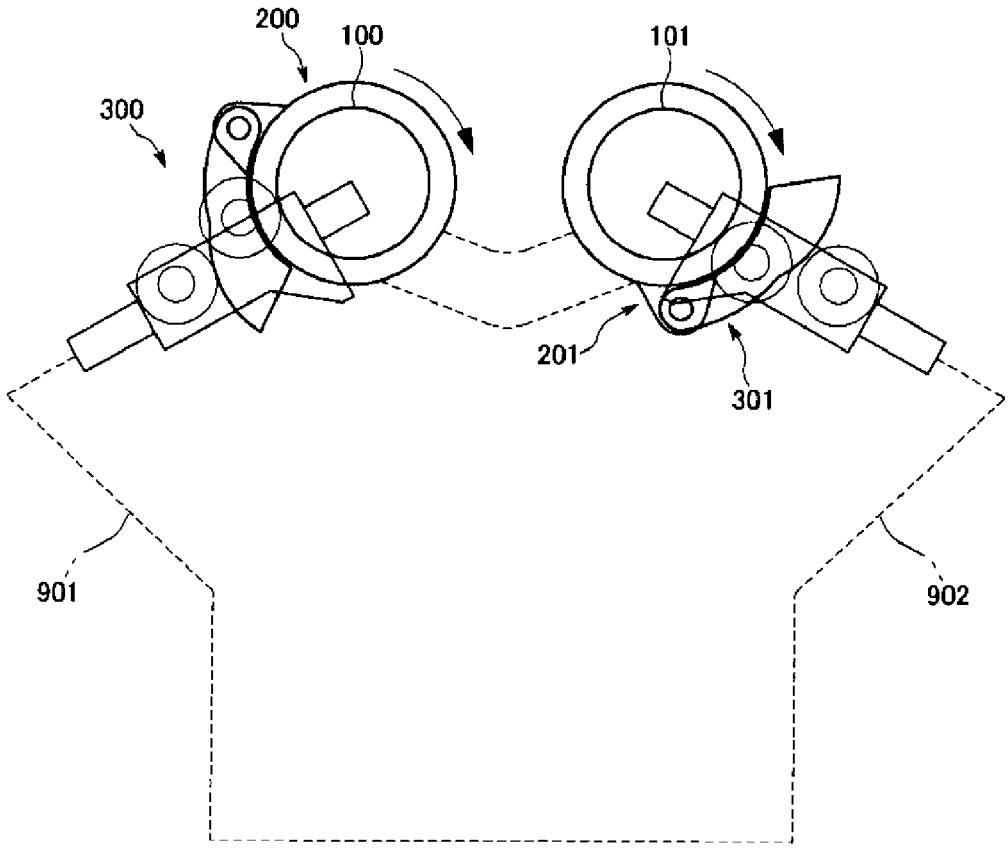
FIG. 10 is a drawing showing disposition of a pair of exemplary continuously variable valve lift apparatuses according to the present invention.

FIG. 10 is a drawing showing disposition of a continuously variable valve lift apparatus in a pair to left and right banks 901 and 902.

In various embodiments, as shown in FIG. 10, even if both camshafts 100 and 101 rotate in the same direction, the same valve profile can be obtained.

Compared to the exemplary embodiment illustrated in FIG. 1, a follower 300 and a follower supporting portion 200 of the right side of the continuous variable valve apparatus are oppositely disposed, and other elements are symmetrically disposed.

As shown in FIG. 10, when the camshafts 100 and 101 rotate in the same direction, the same profile can be obtained, so that the continuously variable valve lift apparatus can be used in a V-type engine.

Figure 11:
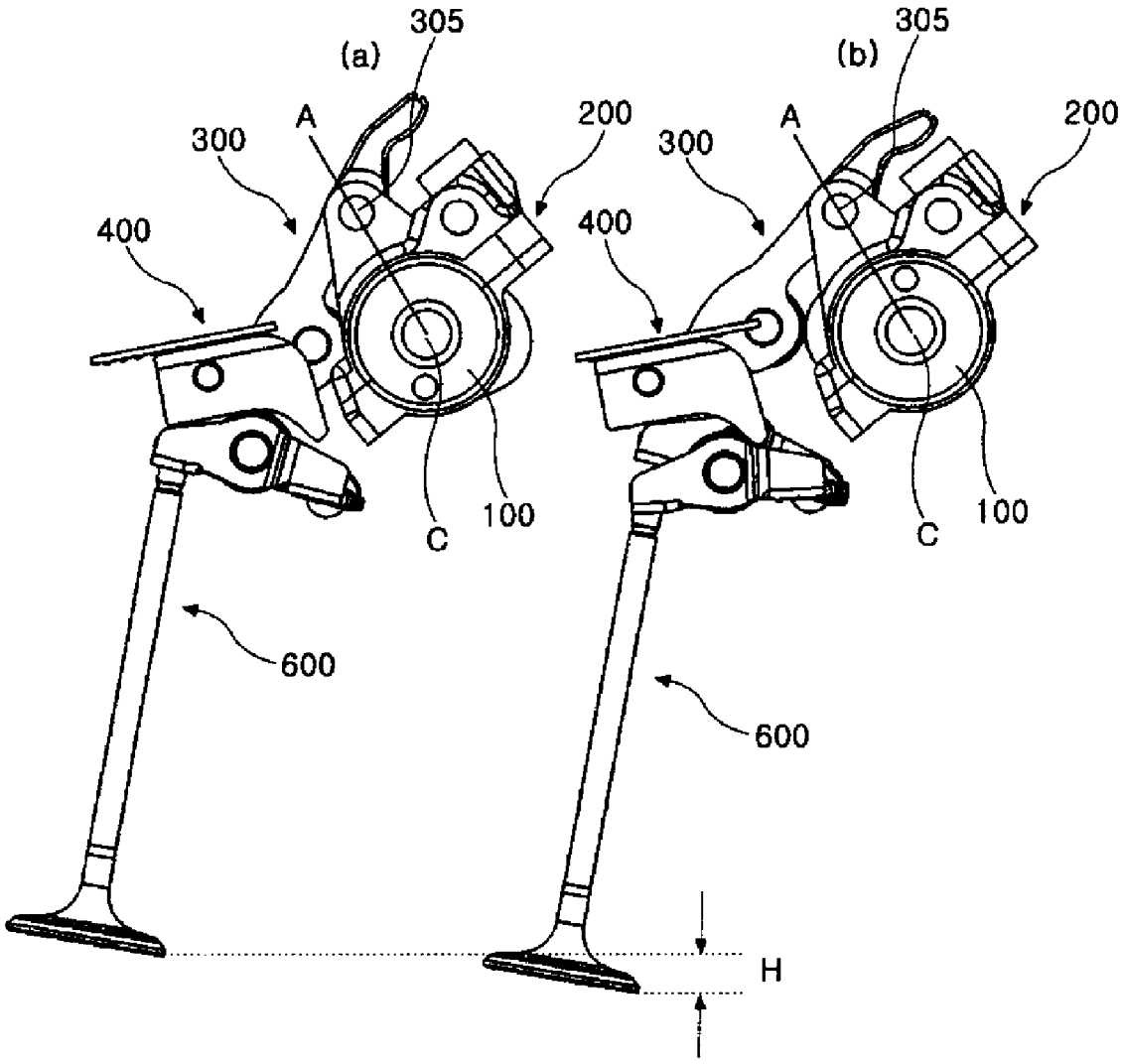
FIG. 11 is a drawing showing operation in high lift mode of an exemplary continuously variable valve lift apparatus according to the present invention.
Figure 12:
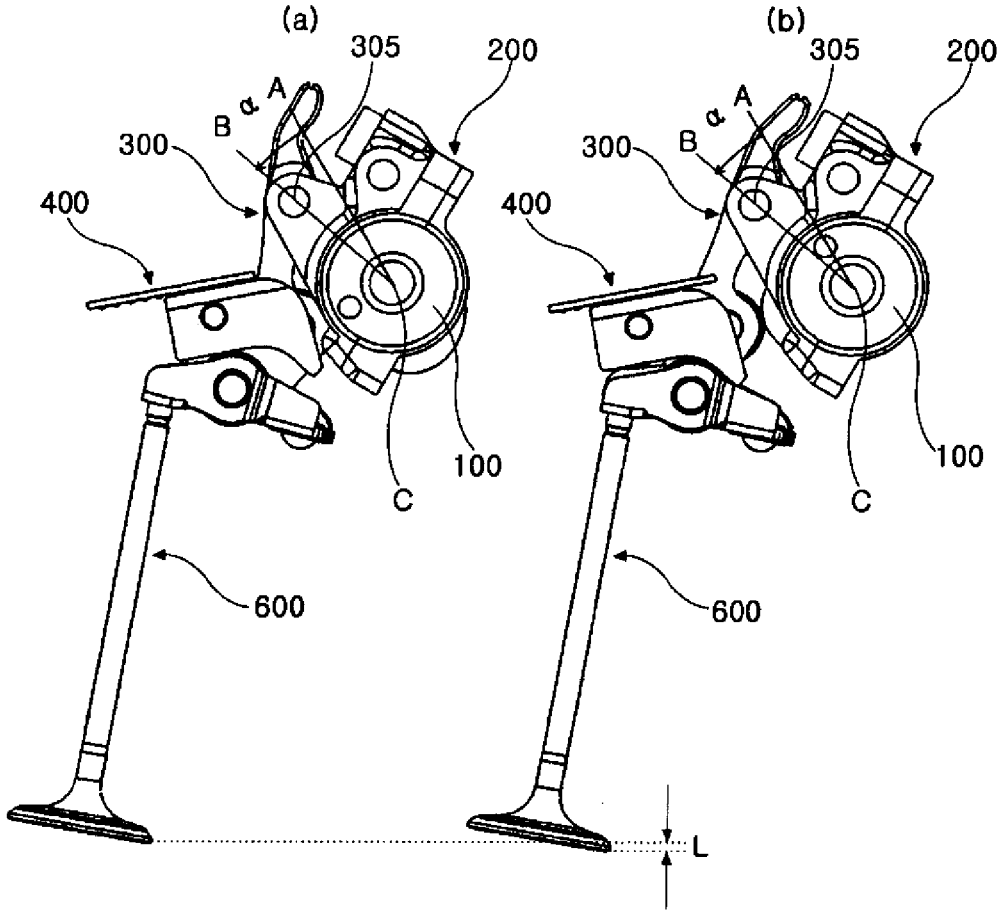
FIG. 12 is a drawing showing operation in low lift mode of an exemplary continuously variable valve lift apparatus according to the present invention.

FIG. 11 and FIG. 12 are drawings respectively showing an operation of a continuously variable valve lift apparatus according to various embodiments of the present invention in high lift mode and in low lift mode.

"A" shown in FIG. 11 and FIG. 12 indicates a line connecting the center of the camshaft C and the center shaft 305 in high lift mode, "B" shown in FIG. 12 indicates a line connecting the center of the camshaft C and the center shaft 305 in low lift mode, and "a" indicates a relative angle between the lines A and B.

In the high lift mode, as shown in FIG. 11, as the control connecting portion 202 moves to the right the reciprocating output cam 500 relatively moves to the left in the drawing.

Thus, the relative distance between the first roller 310 and the camshaft 100 is increased and thereby a time interval that the valve opening unit 600 contacts the lift section 520 of the output cam 500 is increased, and valve lift amount of the valve 610 and lifting timing is increased.

In the low lift mode, as shown in FIG. 12, as the control connecting portion 202 moves to the left the reciprocating output cam 500 relatively moves to the right in the drawing.

Thus, the relative distance between the first roller 310 and the camshaft 100 is decreased and thereby a time interval that the valve opening unit 600 contacts the lift section 520 of the output cam 500 is reduced, and valve lift amount of the valve 610 and lifting timing is reduced.

A design change of the driving portion 540 or adjustment of the "α" can make the valve opening unit 600 contact only the zero lift section 510, and in this case, the continuously variable valve lift apparatus according to various embodiments of the present invention can realize CDA (cylinder deactivation).

With the scheme as described above, the continuously variable valve lift apparatus according to various aspects of the present invention may easily adjust valve lift by a simple design change or by adjusting position of the follower, and also, CDA operation can be realized.

The continuously variable valve lift apparatus according to an aspect of the present invention may have a symmetrical valve profile so that the continuously variable valve lift apparatus can be used for a V-type engine.

Because it is provided with a straight line guide, the design thereof can be easily changed and durability can be improved.

When valve lift is reduced, a peak point of the valve lift is advanced.

For convenience in explanation and accurate definition in the appended claims, the terms "front", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:

an input cam connected to a camshaft and rotating with rotation of the camshaft;

a follower supporting portion rotatably coupled to the camshaft;

a follower including a center shaft, wherein the follower is pivotally coupled to the follower supporting portion via the center shaft, and pivots around the center shaft by receiving rotation movement of the input cam so as to change a relative angle of the follower with respect to the camshaft;

a straight line guide;

an output cam that slidably contacts the follower and reciprocates along the straight line guide; and a valve opening unit that is opened or closed by the output cam.

2. The continuously variable valve lift apparatus of claim 1, wherein the follower supporting portion comprises a connecting portion rotatably connected with a cylinder head and the cam shaft.

3. The continuously variable valve lift apparatus of claim 2, wherein a first elastic member is disposed between the follower and the follower supporting portion, and supplies elastic force to the follower so that the follower is biased toward the input cam.

4. The continuously variable valve lift apparatus of claim 1, wherein the follower comprises a first roller that contacts the input cam.

5. The continuously variable valve lift apparatus of claim 1, wherein the follower comprises a contact portion that slidably contacts the output cam.

6. The continuously variable valve lift apparatus of claim 1, wherein the output cam comprises a second roller that slidably contacts the follower.

7. The continuously variable valve lift apparatus of claim 1, wherein a second elastic member is disposed behind the output cam for supplying elastic force to the output cam so that the output cam is biased toward the follower.

8. The continuously variable valve lift apparatus of claim 1, wherein the straight line guide comprises a guide roller for the output cam to reciprocate thereon.

9. The continuously variable valve lift apparatus of claim 1, wherein the output cam comprises a driving portion having a zero lift section substantially in parallel to the straight line guide and a lift section that becomes gradually more distant from the zero lift section.

10. The continuously variable valve lift apparatus of claim 9, wherein the driving portion further includes a ramp section formed between the zero lift section and the lift section for preventing a rapid change in valve profile.

11. The continuously variable valve lift apparatus of claim 9, wherein a straight line, which connects a contact point formed between the follower and a curvature of the output cam and a center of the camshaft, is substantially in parallel to longitudinal axis of the straight line guide.

12. The continuously variable valve lift apparatus of claim 1, further comprising a control portion for controlling the relative angle of the follower with respect to the camshaft.

13. The continuously variable valve lift apparatus of claim 12, wherein the control portion comprises a control shaft.

14. The continuously variable valve lift apparatus of claim 12, wherein the control portion further comprises an eccentric shaft housing, and a stopper is formed to the eccentric shaft housing for limiting the relative angle of the follower with respect to the camshaft within a predetermined angle, wherein the eccentric shaft housing is rotatably coupled to the follower supporting portion and the control shaft is coupled to the eccentric shaft housing so that rotation centers of the control shaft and the eccentric shaft housing are offset with a predetermined distance.

15. The continuously variable valve lift apparatus of claim 1, wherein a pair of input cams, the straight line guides, the output cams, and the valve opening units are disposed on the engine, the input cams rotate in the same direction, and the followers and the follower supporting portions are reversely disposed with respect to a straight line connecting rotation centers of a pair of the camshafts for having the same valve profile.

16. An engine comprising the continuously variable valve lift apparatus of claim 1.

17. A passenger vehicle comprising the engine of claim 16.

* * * * *